US011719183B2

(12) United States Patent
Steiner et al.

(10) Patent No.: US 11,719,183 B2
(45) Date of Patent: Aug. 8, 2023

(54) METHODS AND SYSTEMS FOR COOLING ARRANGEMENT

(71) Applicant: Ford Global Technologies, LLC, Dearborn, MI (US)

(72) Inventors: Bernd Steiner, Duesseldorf (DE); Ravi Gopal, Novi, MI (US); Ronald Semel, West Bloomfield, MI (US); Jody Michael Slike, Farmington Hills, MI (US); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 32 days.

(21) Appl. No.: 17/454,218

(22) Filed: Nov. 9, 2021

(65) Prior Publication Data

US 2023/0142862 A1 May 11, 2023

(51) Int. Cl.

| | |
|---|---|
| ***F02F 1/16*** | (2006.01) |
| ***F01P 3/14*** | (2006.01) |
| ***F01P 5/10*** | (2006.01) |

(52) U.S. Cl.

CPC ..... *F02F 1/16* (2013.01); *F01P 3/14* (2013.01); *F01P 5/10* (2013.01)

(58) Field of Classification Search

CPC ..... F02F 1/16; F01P 5/10; F01P 3/14

See application file for complete search history.

(56) References Cited

U.S. PATENT DOCUMENTS

| | | | | |
|---|---|---|---|---|
| 7,032,547 | B2 * | 4/2006 | Xin | F02F 1/108 123/41.72 |
| 2009/0308335 | A1 * | 12/2009 | Dipaola | F01P 7/165 123/41.1 |
| 2016/0069248 | A1 * | 3/2016 | Beyer | F01P 3/02 123/41.74 |
| 2017/0167431 | A1 | 6/2017 | Jang | |
| 2017/0342939 | A1 * | 11/2017 | Araki | F02F 1/14 |
| 2017/0350302 | A1 | 12/2017 | Araki et al. | |

FOREIGN PATENT DOCUMENTS

| | | | |
|---|---|---|---|
| AT | 15665 | U1 | 4/2018 |
| JP | H11294254 | A | 10/1999 |
| JP | 2000345838 | A | 12/2000 |
| JP | 2007056771 | A | 3/2007 |
| JP | 5892050 | B2 | 3/2016 |
| JP | 2018105275 | A | 7/2018 |
| KR | 20180060129 | A | 6/2018 |
| WO | 2020107052 | A1 | 6/2020 |

* cited by examiner

*Primary Examiner* — Kevin A Lathers

(74) *Attorney, Agent, or Firm* — Vincent Mastrogiacomo; McCoy Russell LLP

(57) ABSTRACT

Methods and systems are provided for a cooling arrangement. In one example, a system comprises a separator arranged in a block coolant jacket. The separator fluidly separates an upper portion of the block coolant jacket from a lower portion of the block coolant jacket.

19 Claims, 8 Drawing Sheets

METHODS AND SYSTEMS FOR COOLING ARRANGEMENT

ACKNOWLEDGMENT OF GOVERNMENT SUPPORT

This material is based upon work supported by the U.S. Department of Energy under Award Number DE-EE0008878. The government has certain rights in the invention.

FIELD

The present description relates generally to a cooling arrangement for an engine including a coolant jacket separator.

BACKGROUND/SUMMARY

Emissions standards continue to become more stringent in order to combat global warming. Manufacturers may continue to modify operating parameters and architectures to decrease emissions across a vehicle fleet. One area of focus may include adjusting a cooling arrangement of an engine, such as an internal combustion engine of a vehicle.

Some vehicle arrangements may demand enhanced temperature settings to decrease friction while also decreasing knock. One example approach includes one or more cooling passages fluidly coupling a head jacket portion to a block jacket portion in a cylinder bridge area. Other examples of addressing engine temperature control to decrease emissions and improve performance include adjusting the cooling arrangement to shift a cooling flow direction. In one example, coolant from the head may flow directly to the block or to a remainder of the cooling arrangement, known as cross reverse serial cooling. However, during low loads, the temperature rise across the head is relatively low, and benefits of such examples are reduced at low loads where emissions may be more problematic. At high loads, fuel consumption in such a system may be increased due to knocking.

In one example, the issues described above may be addressed by a system including a separator arranged in a block coolant jacket, wherein the separator seals an upper portion of the block coolant jacket from a lower portion of the block coolant jacket. In this way, a temperature of the lower portion may be higher than a temperature of the upper portion, which may reduce friction, knock, and cylinder bore distortions.

As one example, the separator may be circular and transverse an entire circumference of the coolant jacket. A coolant circuit may be configured to flow coolant directly from a section of the head portion to the lower portion of the block portion. The coolant circuit may include a pump configured to receive a plurality of inputs from various portions of the coolant circuit and expel coolant to a plurality of outputs based on signals from a controller. By doing this, thermal management of the engine and its components may be enhanced, which may increase fuel economy and efficiency.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1-6D are shown approximately to scale, however, other dimensions may be used if desired.

DETAILED DESCRIPTION

Figure 1:
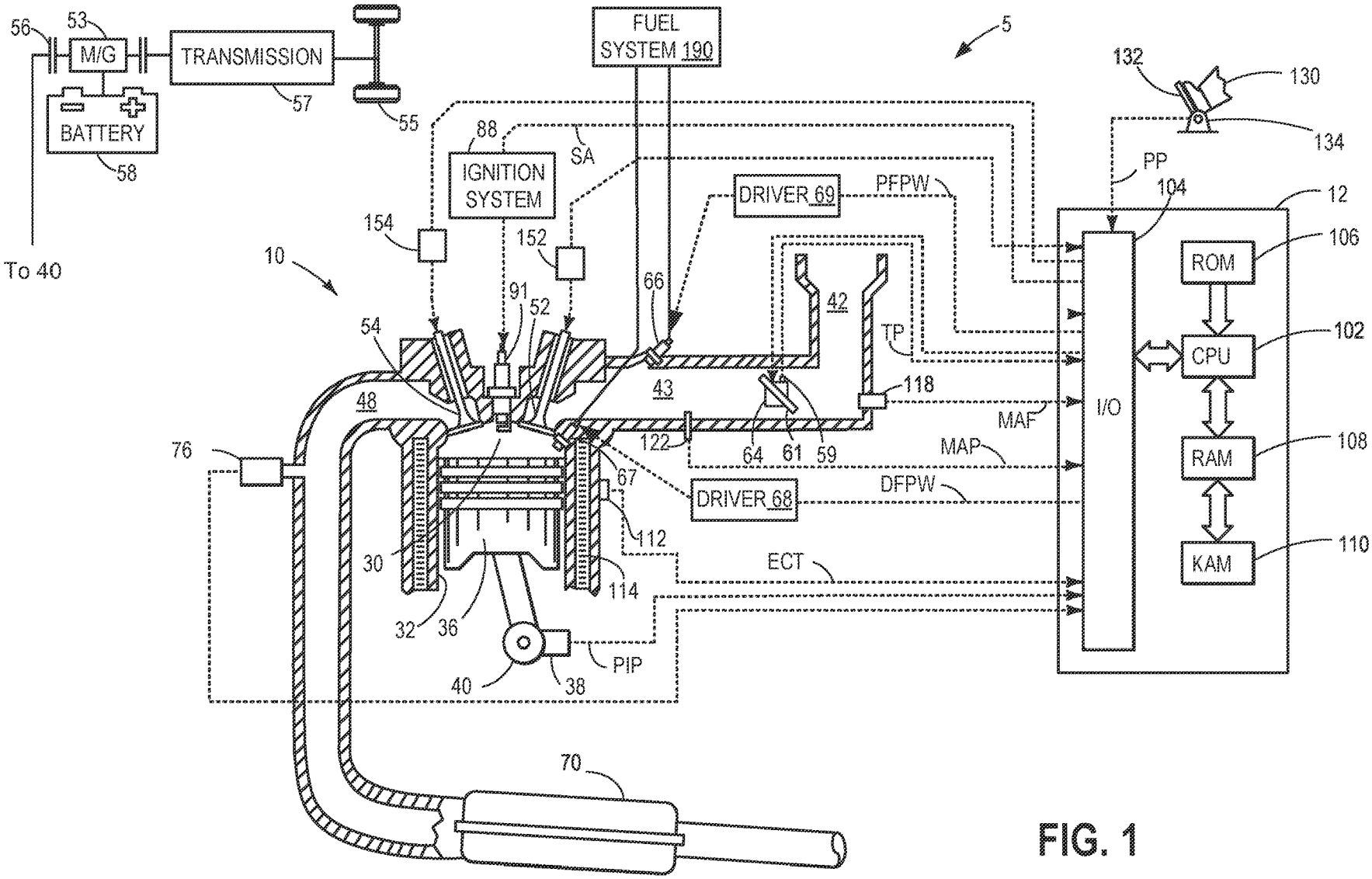
FIG. 1 illustrates a schematic of an engine included in a hybrid vehicle.
Figure 2:
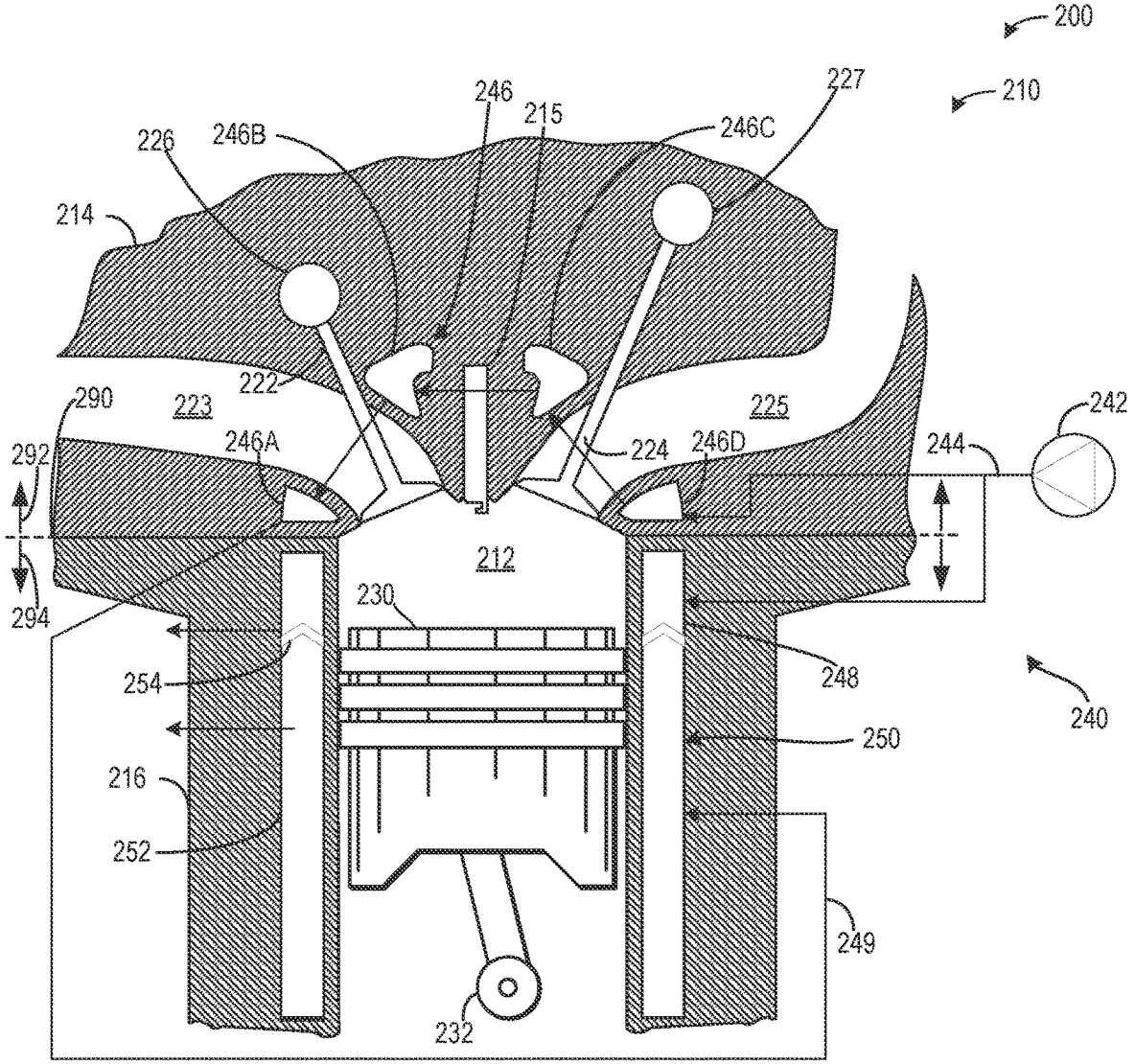
FIG. 2 illustrates a first example of a detailed view of a coolant jacket of a cylinder of a cooling arrangement of the engine.
Figure 4:
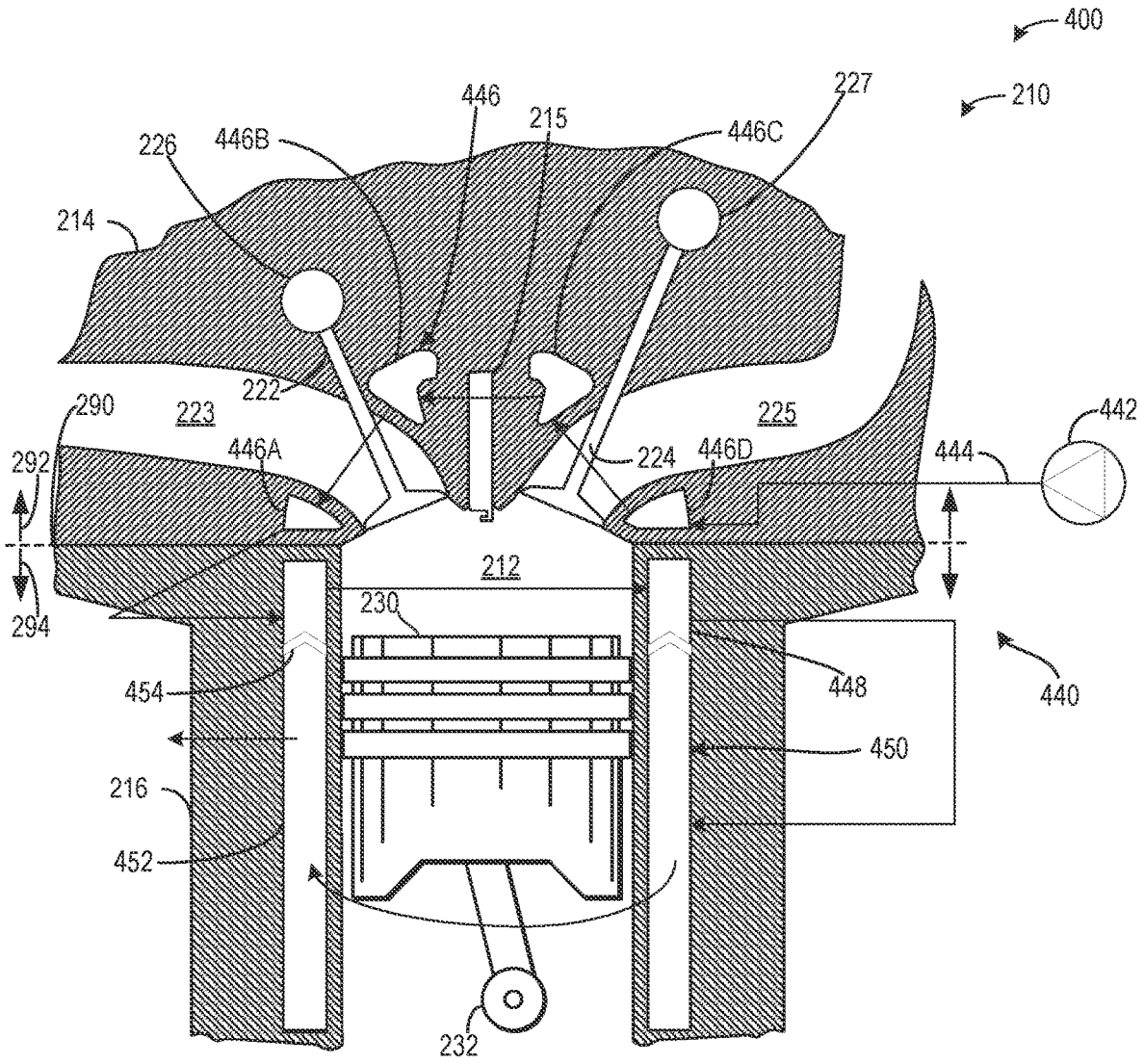
FIG. 4 illustrates a second example of a detailed view of a coolant jacket of a cylinder of a cooling arrangement of the engine.
Figure 5:
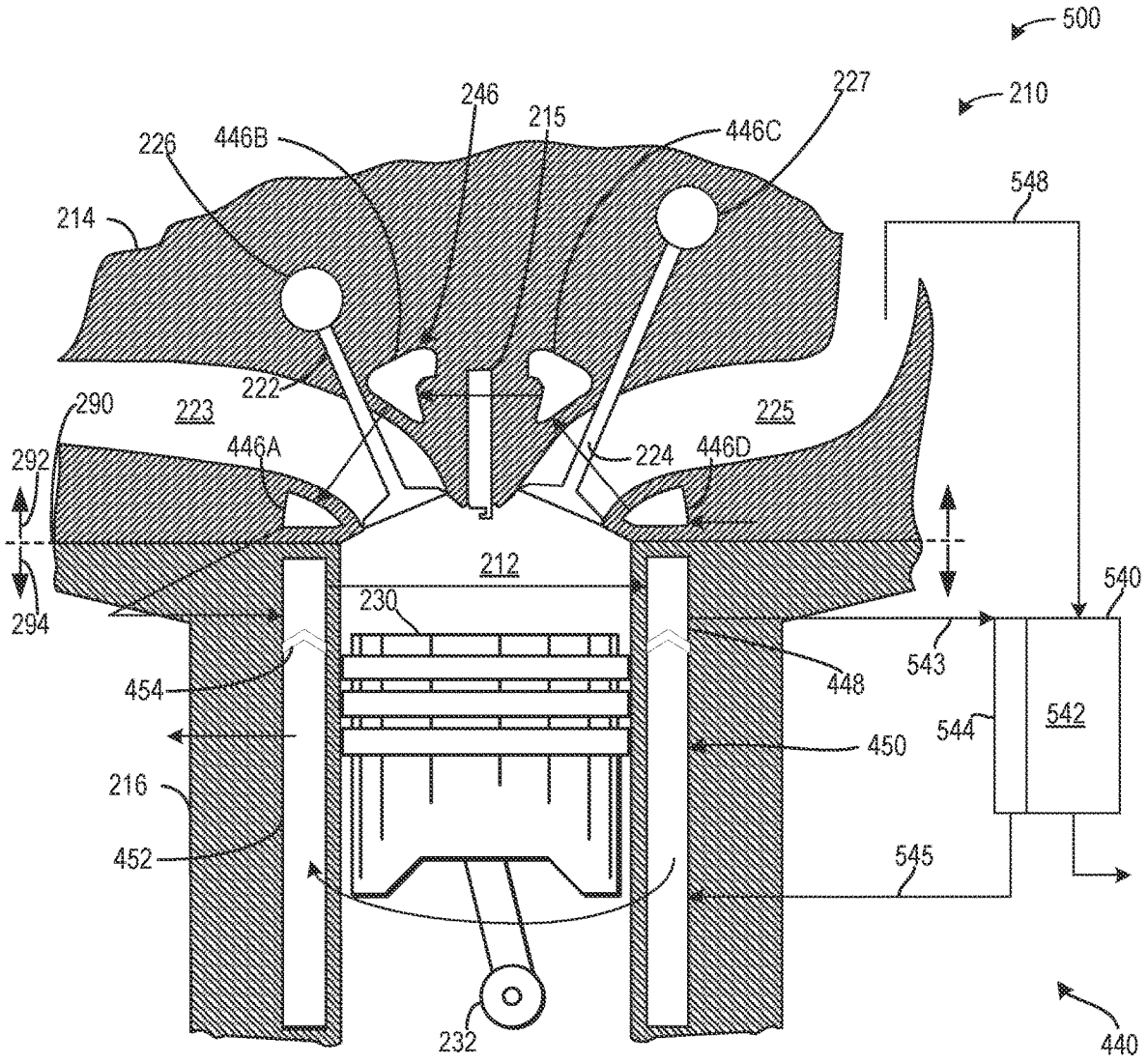
FIG. 5 illustrates a third example of a detailed view of a coolant jacket of a cylinder of a cooling arrangement of the engine.

The following description relates to systems and methods for a cooling arrangement of an engine. A system may include a vehicle including the engine and the cooling arrangement, as is illustrated in FIG. 1. The cooling arrangement may include a first example of a coolant jacket of a cylinder, as shown in FIG. 2. A second example of a coolant jacket is shown in FIG. 4 and a third example of a coolant jacket is shown in FIG. 5. The examples of a coolant jacket may each include a separator, examples of which are shown in FIGS. 3A, 3B, 3C, and 3D.

The cooling arrangement may further comprise a bridge cooling portion as illustrated in FIGS. 6A, 6B, 6C, and 6D. Coolant flow to the bridge cooling circuit may be independent of coolant flow to the head and/or block coolant jacket, providing greater temperature control.

Figure 7:
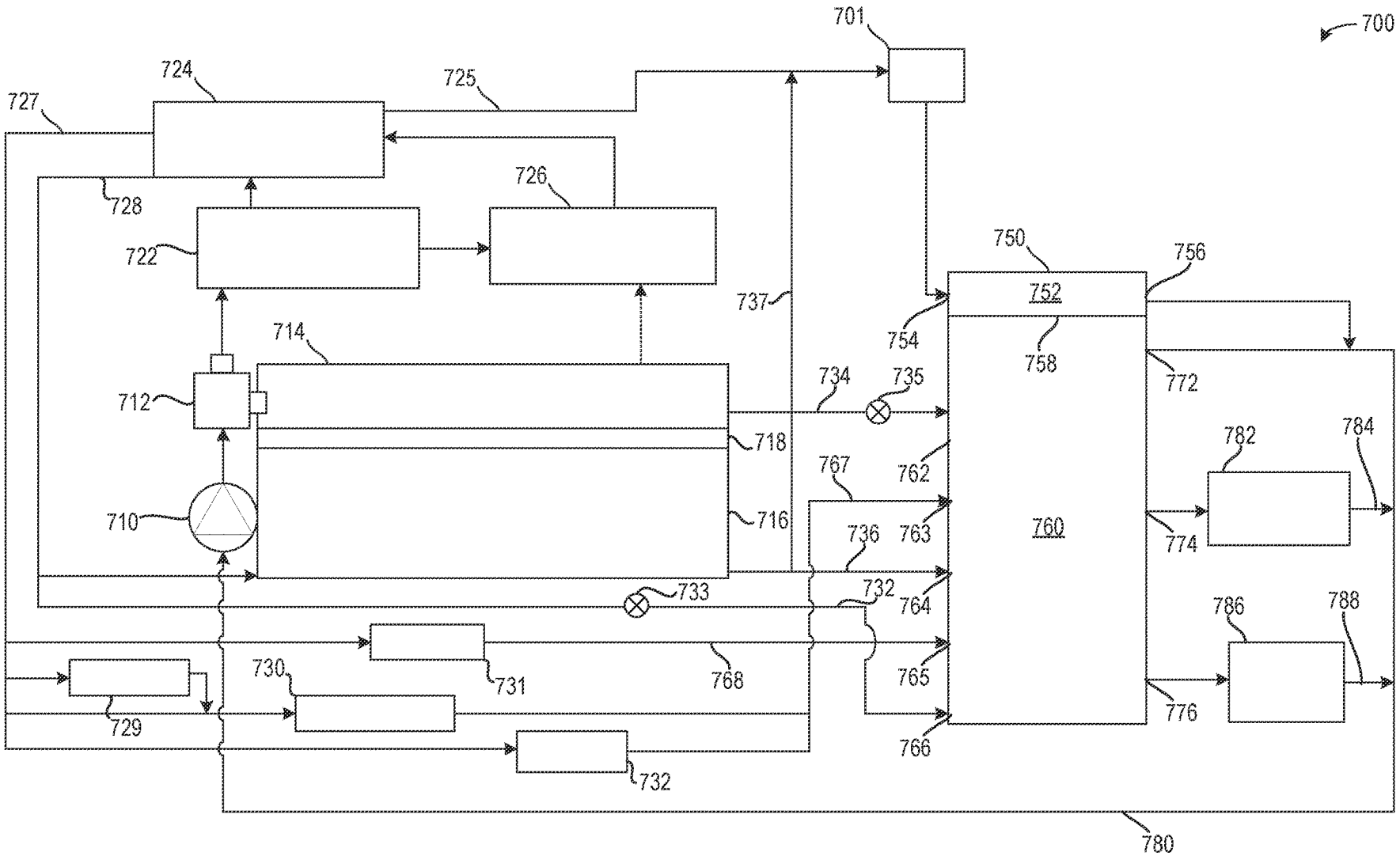
FIG. 7 illustrates an example of a coolant circuit of a cooling arrangement.
Figure 8:
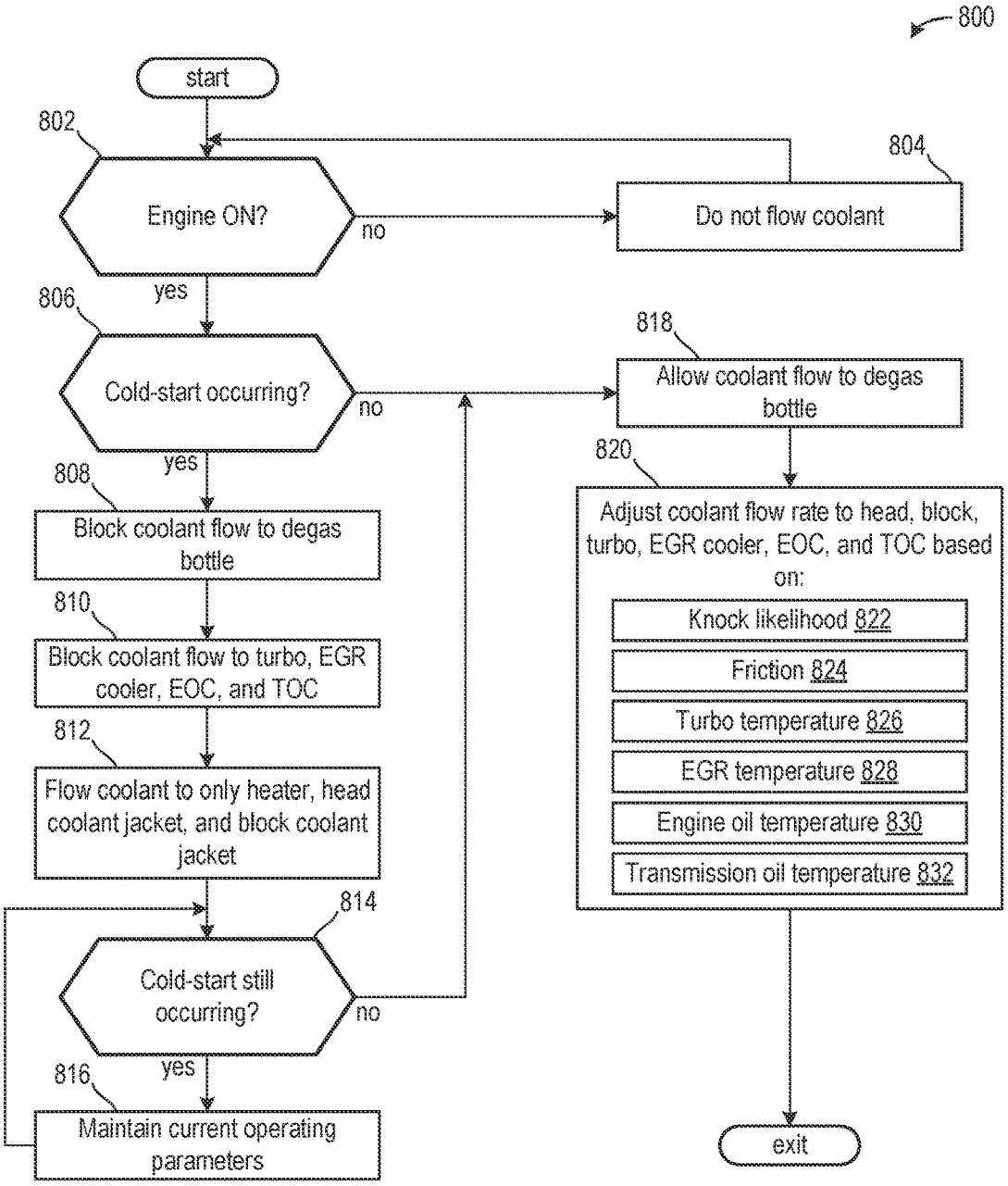
FIG. 8 illustrates a method for operating the coolant control module based on engine conditions.

A coolant circuit coupled to the coolant jacket may further include a coolant control module configured to flow coolant to different areas of an engine in response to engine conditions is shown in FIG. 7. A method for operating the coolant control module based on engine conditions is shown in FIG. 8.

FIGS. 1-7 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

FIG. 1 shows a schematic depiction of a spark ignition internal combustion engine 10 with a dual injector system, where engine 10 is configured with both direct injection and port fuel injection. As such, engine 10 may be referred to as a port-fuel direct inject (PFDI) engine. Engine 10 may be included in a vehicle 5. Engine 10 comprises a plurality of cylinders of which one cylinder 30 (also known as combustion chamber 30) is shown in FIG. 1. Cylinder 30 of engine 10 is shown including combustion chamber walls 32 with piston 36 positioned therein and connected to crankshaft 40. A starter motor (not shown) may be coupled to crankshaft 40 via a flywheel (not shown), or alternatively, direct engine starting may be used.

Combustion chamber 30 is shown communicating with intake manifold 43 and exhaust manifold 48 via intake valve 52 and exhaust valve 54, respectively. In addition, intake manifold 43 is shown with throttle 64 which adjusts a position of throttle plate 61 to control airflow from intake passage 42.

Intake valve 52 may be operated by controller 12 via actuator 152. Similarly, exhaust valve 54 may be activated by controller 12 via actuator 154. During some conditions, controller 12 may vary the signals provided to actuators 152 and 154 to control the opening and closing of the respective intake and exhaust valves. The position of intake valve 52 and exhaust valve 54 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 30 may alternatively include an intake valve controlled via electric valve actuation and an exhaust valve controlled via cam actuation including CPS and/or VCT. In other embodiments, the intake and exhaust valves may be controlled by a common valve actuator or actuation system, or a variable valve timing actuator or actuation system.

In another embodiment, four valves per cylinder may be used. In still another example, two intake valves and one exhaust valve per cylinder may be used.

Combustion chamber 30 can have a compression ratio, which is the ratio of volumes when piston 36 is at bottom center to top center. In one example, the compression ratio may be approximately 9:1. However, in some examples where different fuels are used, the compression ratio may be increased. For example, it may be between 10:1 and 11:1 or 11:1 and 12:1, or greater.

In some embodiments, each cylinder of engine 10 may be configured with one or more fuel injectors for providing fuel thereto. As shown in FIG. 1, cylinder 30 includes two fuel injectors, 66 and 67. Fuel injector 67 is shown directly coupled to combustion chamber 30 and positioned to directly inject therein in proportion to the pulse width of signal DFPW received from controller 12 via electronic driver 68. In this manner, direct fuel injector 67 provides what is known as direct injection (hereafter referred to as "DI") of fuel into combustion chamber 30. While FIG. 1 shows injector 67 as a side injector, it may also be located overhead of the piston, such as near the position of spark plug 91. Such a position may improve mixing and combustion due to the lower volatility of some alcohol based fuels. Alternatively, the injector may be located overhead and near the intake valve to improve mixing.

Fuel injector 66 is shown arranged in intake manifold 43 in a configuration that provides what is known as port injection of fuel (hereafter referred to as "PFI") into the intake port upstream of cylinder 30 rather than directly into cylinder 30. Port fuel injector 66 delivers injected fuel in proportion to the pulse width of signal PFPW received from controller 12 via electronic driver 69.

Fuel may be delivered to fuel injectors 66 and 67 by a high pressure fuel system 190 including a fuel tank, fuel pumps, and fuel rails. Further, the fuel tank and rails may each have a pressure transducer providing a signal to controller 12. In this example, both direct fuel injector 67 and port fuel injector 66 are shown. However, certain engines may include only one kind of fuel injector such as either direct fuel injector or port fuel injector. Fuel injection to each cylinder may be carried out via direct injectors (in absence of port injectors) or port direct injectors (in absence of direct injectors).

Returning to FIG. 1, exhaust gases flow through exhaust manifold 48 into emission control device 70 which can include multiple catalyst bricks, in one example. In another example, multiple emission control devices, each with multiple bricks, can be used. Emission control device 70 can be a three-way type catalyst in one example.

Exhaust gas sensor 76 is shown coupled to exhaust manifold 48 upstream of emission control device 70 (where sensor 76 can correspond to a variety of different sensors). For example, sensor 76 may be any of many known sensors for providing an indication of exhaust gas air/fuel ratio such as a linear oxygen sensor, a UEGO, a two-state oxygen sensor, an EGO, a HEGO, or an HC or CO sensor. In this particular example, sensor 76 is a two-state oxygen sensor that provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS may be used to advantage during feedback air/fuel control to maintain average air/fuel at stoichiometry during a stoichiometric homogeneous mode of operation. A single exhaust gas sensor may serve 1, 2, 3, 4, 5, or other number of cylinders.

Distributorless ignition system 88 provides ignition spark to combustion chamber 30 via spark plug 91 in response to spark advance signal SA from controller 12.

Controller 12 may cause combustion chamber 30 to operate in a variety of combustion modes, including a homogeneous air/fuel mode and a stratified air/fuel mode by controlling injection timing, injection amounts, spray patterns, etc. Further, combined stratified and homogenous mixtures may be formed in the chamber. In one example, stratified layers may be formed by operating injector 67 during a compression stroke. In another example, a homogenous mixture may be formed by operating one or both of injectors 66 and 67 during an intake stroke (which may be open valve injection). In yet another example, a homogenous mixture may be formed by operating one or both of injectors 66 and 67 before an intake stroke (which may be closed valve injection). In still other examples, multiple injections from one or both of injectors 66 and 67 may be used during one or more strokes (e.g., intake, compression, exhaust, etc.). Even further examples may be where different injection timings and mixture formations are used under different conditions, as described below.

As described above, FIG. 1 merely shows one cylinder of a multi-cylinder engine, and that each cylinder has its own set of intake/exhaust valves, fuel injectors, spark plugs, etc. Also, in the example embodiments described herein, the engine may be coupled to a starter motor (not shown) for starting the engine. The starter motor may be powered when the driver turns a key (or presses an ignition button) in the ignition switch on the steering column, for example. The starter is disengaged after engine start, for example, by engine 10 reaching a predetermined speed after a predetermined time. Further, in the disclosed embodiments, an exhaust gas recirculation (EGR) system may be used to route a desired portion of exhaust gas from exhaust manifold 48 to intake manifold 43 via an EGR valve.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 53. Electric machine 53 may be a motor or a motor/generator. Crankshaft 40 of engine 10 and electric machine 53 are connected via a transmission 57 to vehicle wheels 55 when one or more clutches 56 are engaged. In the depicted example, a first clutch 56 is provided between crankshaft 40 and electric machine 53, and a second clutch 56 is provided between electric machine 53 and transmission 57. Controller 12 may send a signal to an actuator of each clutch 56 to engage or disengage the clutch, so as to connect or disconnect crankshaft 40 from electric machine 53 and the components connected thereto, and/or connect or disconnect electric machine 53 from transmission 57 and the components connected thereto. Transmission 57 may be a gearbox, a planetary gear system, or another type of transmission. The powertrain may be configured in various manners including as a parallel, a series, or a series-parallel hybrid vehicle.

Electric machine 53 receives electrical power from a traction battery 58 to provide torque to vehicle wheels 55. Electric machine 53 may also be operated as a generator to provide electrical power to charge battery 58, for example during a braking operation.

Controller 12 is shown in FIG. 1 as a conventional microcomputer including: central processing unit (CPU) 102, input/output (I/O) ports 104, read-only memory (ROM) 106, random access memory (RAM) 108, keep alive memory (KAM) 110, and a conventional data bus. Controller 12 is shown receiving various signals from sensors coupled to engine 10, in addition to those signals previously discussed, including measurement of inducted mass air flow (MAF) from mass air flow sensor 118; engine coolant temperature (ECT) from temperature sensor 112 coupled to cooling sleeve 114; a profile ignition pickup signal (PIP) from Hall effect sensor 38 coupled to crankshaft 40; and throttle position TP from throttle position sensor 59 and a Manifold Absolute Pressure Signal (MAP) from sensor 122. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder. In one example, sensor 38, which is also used as an engine speed sensor, produces a predetermined number of equally spaced pulses every revolution of the crankshaft. The controller 12 receives signals from the various sensors of FIG. 1 and employs the various actuators of FIG. 1, such as throttle 64, fuel injectors 66 and 67, spark plug 91, coolant pump, etc., to adjust engine operation based on the received signals and instructions stored on a memory of the controller.

Turning now to FIG. 2, it shows an embodiment 200 of a cylinder 210. In one example, the cylinder 210 may be used similarly to combustion chamber 30. As such, the cylinder 210 may be included in engine 10 of FIG. 1 and include one or more of the sensors and actuators previously described.

The cylinder 210 may include a combustion chamber 212 shaped via walls of a cylinder head 214 and a cylinder block 216. Arrow 292 points to a head side of the cylinder 210 and arrow 294 points to a block side of the cylinder 210. The dashed axis between the arrows 292, 294 illustrates an interface between the cylinder head 214 and the cylinder block 216.

The cylinder head 214 may include a spark plug 215 projecting into the combustion chamber 212. The cylinder head 214 may further include an intake valve 222 arranged in an intake port 223 and an exhaust valve 224 arranged in an exhaust port 225. Each of the intake valve 222 and the exhaust valve 224 may be operated via respective camshafts 226, 227.

The volume of the combustion chamber 212 may be further defined via a piston 230. The piston 230 may be coupled to a connecting rod 232 configured to move as the piston 230 oscillates. A crankshaft, coupled to the connecting rod 232, may rotate as the connecting rod 232 moves. The connecting rod 232 and crankshaft extend to a crankcase arranged below the cylinder block 216.

A cooling arrangement 240 is further illustrated in the embodiment 200. The cooling arrangement 240 may include a pump 242 configured to direct coolant through one or more passages. As shown, a pump outlet passage 244 may bifurcate and direct coolant to a head jacket portion 246 and an upper block jacket portion 248. Coolant flow is illustrated via arrows 249.

The head jacket portion 246 may be shaped to provide thermal management to various areas of the cylinder head 214. For example, the head jacket portion 246 may include a first head portion 246A between the intake port 223 and an interface between the cylinder head 214 and the cylinder block 216. A second head portion 246B may be between the intake port 223 and the spark plug 216. A third head portion 246C may be between the spark plug 216 and the exhaust port 225. A fourth head portion 246D may be between the exhaust port 225 and the interface between the cylinder head 214 and the cylinder block 216. Each of the first through fourth head portions 246A-D may be interconnected. In one example, the pump outlet passage 244 directs coolant to the fourth head portion 246D, coolant in the fourth head portion 246D flows to the third head portion 246C, coolant in the third head portion 246C flows to the second head portion 246B, and coolant from the second head portion 246B flows to the first head portion 246A.

The pump outlet passage 244 may further direct coolant to the upper block jacket portion 248. The upper block jacket portion 248 may be arranged proximally to the interface between the cylinder head 214 and the cylinder block 216. The volume of the upper block jacket portion 248 may be shaped based on a knock sensitivity and a bore distortion temperature in response to combustion temperatures near the cylinder head 214. Thus, for engines with higher combustion temperatures, the volume of the upper block jacket portion 248 may be increased to decrease hot spots and bore distortion.

The upper block jacket portion 248 may be separated from a lower block jacket portion 252 via a separator 254. The upper block jacket portion 248 and the lower block jacket portion 252 may be portions of a block coolant jacket 250. The block coolant jacket 250 may be a single coolant jacket with each of the upper block jacket portion 248, the lower block jacket portion 252, and the separator 254 arranged integrally therein.

The lower block jacket portion 252 may receive coolant from the first head portion 246A in the example of FIG. 2. In one example, the coolant leaving the first head portion 246 may be directed out of the cylinder head 214 and toward the cylinder block 216 in order to enter the lower block jacket portion 252 on the exhaust side of the cylinder block 216. Thus, in one example, coolant flowing from the cylinder head to the lower block jacket portion 252 may leave the intake side of the cylinder head 214 and enter the lower block jacket portion 252 at the exhaust side. The coolant from the first head portion 246A may be heated due head temperatures being higher than block temperatures as a result of combustion, resulting in hotter coolant flowing to the lower block jacket portion 252 compared to the fourth head portion 246D and the upper block jacket portion 248. The hotter coolant in the lower block jacket portion 252 may decrease friction and bore distortions, thereby increasing a longevity of the engine and improving fuel economy. Each of the upper block jacket portion 248 and the lower block jacket portion 252 may expel coolant to a control module from an intake side of the cylinder block 216, as will be described in greater detail with respect to FIG. 7.

The separator 254 may be manufactured via a mold, additive manufacturing, or other similar technique. The separator 254 may include plastic, aluminum, carbon fiber, or other material. The separator 254 may be circular and configured to separate an entirety of the lower block jacket portion 252 from the upper block jacket portion 248. In one example, the separator 254 is uniform such that volumes of the lower block jacket portion 252 and the upper block jacket portion 248 remain constant around an entire circumference of the combustion chamber 212. Additionally or alternatively, the separator 254 may be non-uniform such that volumes of the lower block jacket portion 252 and the upper block jacket portion 248 are non-uniform. For example, it may be desired to include a larger upper block jacket portion volume on an exhaust port 225 side of the combustion chamber 212. In one example, the separator 254 may be sloped such that the volume of the upper block jacket portion 248 is larger on the exhaust port side compared to the intake port side of the combustion chamber 212. Additionally or alternatively, the separator 254 may include multiple shapes. In the example of FIG. 2, a cross-sectional shape of the separator 254 is a V-shape or a chevron shape. As will be described in greater detail below, the separator 254 may include V, linear, rounded, and other shapes along its circumference.

The separator 254 may be shaped to compensate movements of the cylinder block 216 and avoid leakage (e.g., mixing) between coolant in the upper and lower block jacket portions. In one example, the separator 254 may be flexible. The separator 254 may be configured to hermetically seal the upper and lower block jacket portions, which may include blocking flow of gases and liquids between the portions. Additionally or alternatively, the separator 254 may be configured to block flow of certain sized fluids between the upper and lower block jacket portions. For example, the separator 254 may allow gas flow between the upper and lower block jacket portions while selectively blocking liquid flow. Further examples of the separator 254 are shown in FIGS. 3A-3D.

Figures 3A, 3B, 3C, 3D:
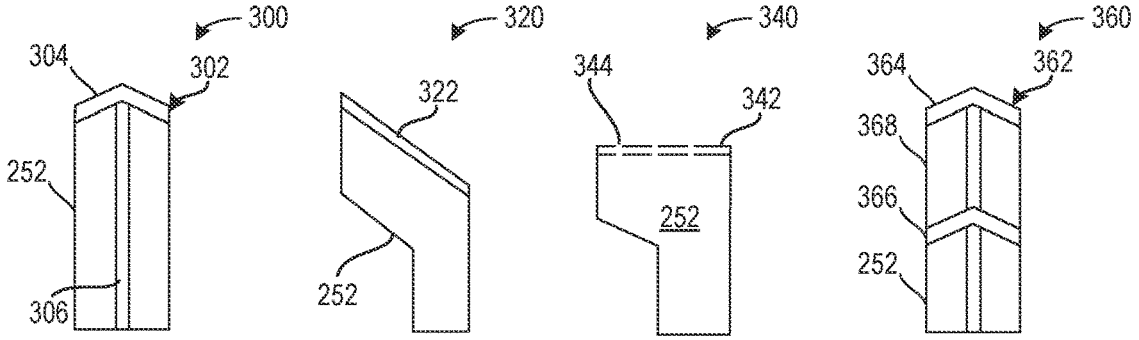
FIGS. 3A, 3B, 3C, and 3D illustrate various embodiments of a separator arranged in the coolant jacket.

Turning now to FIG. 3A, it shows an embodiment 300 of a separator 302. In one example, the separator 302 may be used identically to separator 254 of FIG. 2. The separator 302 may include a body 304 and a support 306. The body 304 may include a chevron shape. Additionally or alternatively, the body 306 may include a V-shape, a C-shape, a U-shape, or other similar shape. The support 306 may extend from a middle portion of the body 304 toward an interior, lower wall of the lower block jacket portion 252. The body 304 may be continuous and extend around an entire circumference of the combustion chamber. The support 306 may not be continuous and the lower block jacket portion 252 may remain a single continuous volume. The support 306 may allow the separator 302 to compensate for cylinder block movements while still allowing the body 304 to kink or move slightly to block leakage.

Turning now to FIG. 3B, it shows an embodiment 320 of a separator 322. The separator 322 may be used identically to separator 254. In one example, the separator 322 is only a portion of the separator 254. The example of FIG. 3B may show a cross-sectional view of a portion of the separator 254 near an outlet of the lower block jacket portion, wherein the portion of the separator 254 is shaped as separator 322. As such, a shape of the separator may change along a circumference of the block jacket 250. The separator 322 may include a chamfered shape. For example, the separator 322 may include an angle greater than 0 and less than 90 degrees configured to promote degassing of the lower block jacket portion 252. In one example, the separator 322 is arranged proximally to an outlet of the lower block jacket portion.

Turning now to FIG. 3C, it shows an embodiment 340 of a separator 342. The separator 342 may be used identically to separator 254. In one example, the separator 342 is only a portion of the separator 254. The separator 342 may include a linear shape with one or more orifices 344 arranged therein. The orifices 344 may be sized to block liquid flow while allowing gas to flow from the lower block jacket portion to the upper block jacket portion. Said another way, the orifices 344 may promote degassing.

In one example, FIGS. 3B and 3C illustrate a coolant block with a step in a cross-section of the coolant jacket. A cylinder wall thickness may be larger at a lower portion of the wall. The angles of the separator of the FIGS. 3B and 3B may be modified from those illustrated.

Turning now to FIG. 3D, it shows an embodiment 360 of a separator 362. The separator 362 may be used identically to the separator 254. In one example, the separator 362 may include multiple of the separator 254. The separator 362 may include a first body 364 and a second body 366 configured to divide the block jacket into three portions. In such an example, a middle block jacket portion 368 may be arranged between the first body 364 and the second body 366. The first body 364 may fluidly separate the upper block jacket portion from the middle block jacket portion 368. The second body 366 may fluidly separate the lower block jacket portion 252 from the middle block jacket portion 368. In one example, a temperature of coolant flowing to the middle block jacket portion 368 may be between a temperature of coolant flowing to the upper block jacket portion and a temperature of coolant flowing to the lower block jacket portion 252. In one example, a mixing valve or other similar device may guide coolant to the middle block jacket portion 368. The mixing valve may receive coolant from the first head portion and the coolant pump (e.g., first head portion 246A and the coolant pump 242 of FIG. 2). In one example, the first body 364 and/or the second body 366 may include one or more of the examples of FIGS. 3A, 3B, and/or 3C.

Turning now to FIG. 4, it shows an embodiment 400 of the cylinder 210. In the embodiment 400, a cooling arrangement 440 is shown comprising a pump 442 configured to flow coolant to a head jacket portion 446 via a pump outlet passage 444. The head jacket portion 446 may be identical to the head jacket portion 246 wherein the head jacket portion 446 includes a first portion 446A, a second portion 446B, a third portion 446C, and a fourth portion 446D.

The cooling arrangement 440 may further comprise where the first portion 446A expels coolant to the upper block jacket portion 448, which may then expel coolant to the lower block jacket portion 452. Coolant flow from the first portion 446A may exit the cylinder head 214 and enter the upper block jacket portion 448 through an intake side of the cylinder block 216. Coolant in the upper block jacket portion 448 may flow in a counterclockwise and/or clockwise direction to an exhaust side of the upper block jacket portion 448 before flowing coolant to the lower block jacket portion 452. The upper block jacket portion 448 may expel coolant to the lower block jacket portion 452 via a coolant passage arranged completely outside of an exhaust side of the block coolant jacket 450. In this way, the head jacket portion 446 may include a first temperature, which is lower than a second temperature of the upper block jacket portion 448. The lower block jacket portion 452 may include a third temperature, which may be greater than the second temperature of the upper block jacket portion 448.

Turning now to FIG. 5, it shows an embodiment 500 including the cooling arrangement 440. In the example of FIG. 5, the cooling arrangement 440 further includes an exhaust gas heat exchanger 540. In one example, the exhaust gas heat exchanger 540 may receive coolant from the upper block coolant jacket 448. Exhaust gases may flow to a chamber 542 of the exhaust gas heat exchanger via an exhaust passage 548, fluidly separated from a heat exchanger coolant chamber 544 thereof, wherein exhaust gases may thermally communicate with the coolant without mixing therewith. The coolant may be directed to the heat exchanger coolant chamber 544 via a heat exchanger inlet 543 from the upper block coolant jacket 448. Coolant may be directed to the lower block coolant jacket 452 from the exhaust gas heat exchanger 540 via a heat exchanger outlet 545. In one example, the exhaust gas heat exchanger 540 may heat the coolant, wherein the heated coolant may be used to heat various portions of the lower block coolant jacket 452 to reduce cold-start times, friction, and/or bore distortions.

Turning now to FIGS. 6A, 6B, 6C, and 6D, they show examples of cylinder bore bridge cooling. Cylinder bore bridge cooling may be arranged between adjacent cylinders of a plurality of cylinders. A cylinder block bore bridge may include a first block curved passage 602 and a second block curved passage 604. The first block curved passage 602 and the second block curved passage 604 may be spaced away and separate from one another. The cylinder head may include a bridging curved passage 606 above and coupled to the first and second block curved passages. Dashed line 690 illustrates a separation between the cylinder head 214 and the cylinder block 216. The bridging curved passage 606 may be fluidly coupled to each of the first block curved passage 602 and the second block curved passage 604. In one example, each of the first block curved passage 602, the second block curved passage 604, and the bridging curved passage 606 are sealed from the head jacket portion 246 and the block jacket portion 250 of FIG. 2. In this way, independent coolant flow in the head and the block may be achieved while providing a temperature control to the bore bridge area.

Coolant in the first and second block curved passages and the bridging curved passage may reduce surface temperatures, cylinder bore distortion, and increase durability. The shape of the first block curved passage 602, the second block curved passage 604, and the bridging curved passage 606 may enhance coolant flow, reduce coolant erosion, and reduce coolant flow pressure drop. In one example, each of the first block curved passage 602, the second block curved passage 604, and the bridging curved passage 606 may comprise a half-oval shape. Additionally or alternatively, the first block curved passage 602, the second block curved passage 604, and the bridging curved passage 606 may comprise a half circle shape, a D-shape, a half-moon shape, or other similar shape.

Figure 6A:
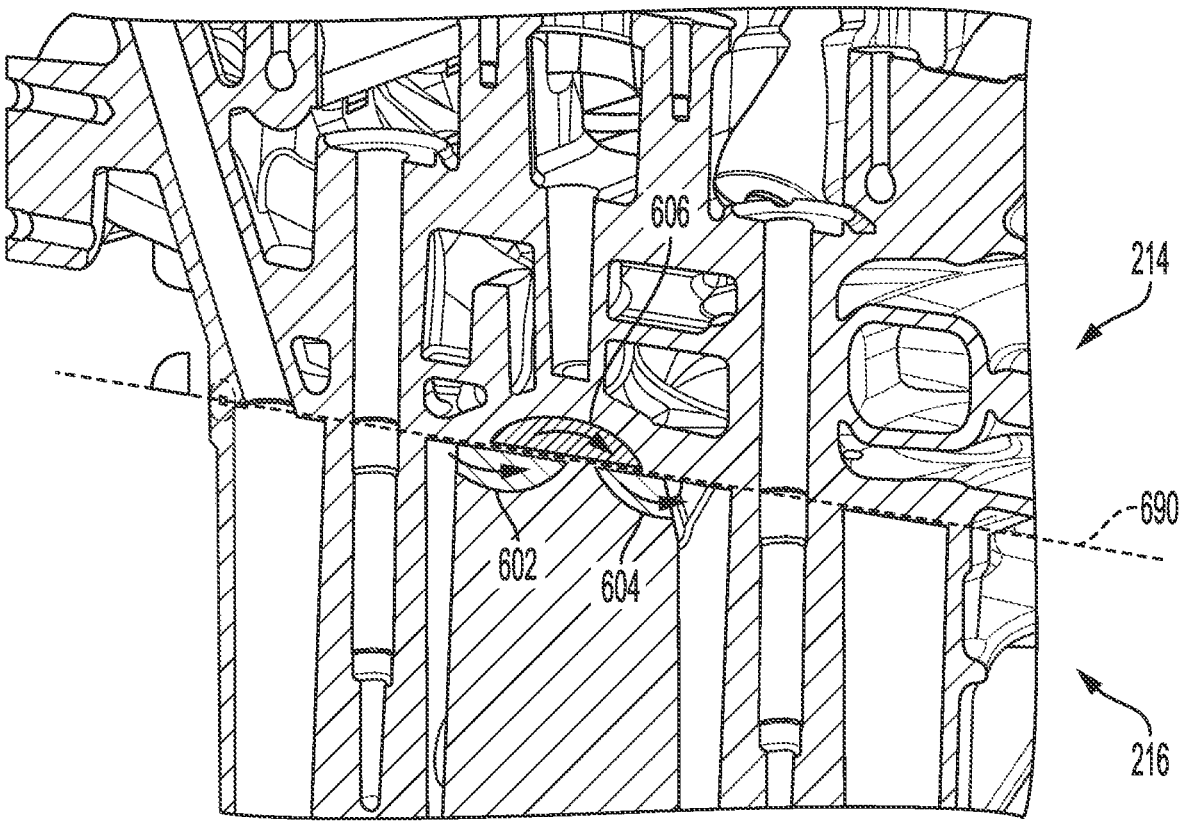
FIGS. 6A, 6B, 6C, and 6D illustrate example of a bridge cooling portion of a cooling arrangement.
Figure 6B:
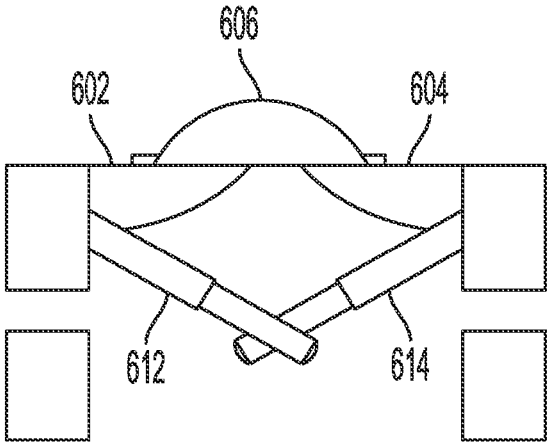

The bore bridging area may further include a pair coolant passages below the first block curved passage 602 and the second block curved passage 604, as shown in FIG. 6B. In one example, the bore bridging area may include a first lower block pas sage 612 and a second lower block passage 614. The first lower block passage 612 may be arranged below the first block curved passage 602 and extend from a first side of the bore bridging area to a second side of the bore bridging area, opposite the first. In one example, the first side is an exhaust side and the second side is an intake side. The second lower block passage 614 may be arranged below the second block curved passage 604 and extend from the first side to the second side of the bore bridging area. The first lower block passage 612 and the second lower block passage 614 may interconnect at a region below respective inlets. In this way, the first lower block passage 612 and the second lower block passage 614 may be angled in a direction away from the first block curved passage and the second block curved passage 604. By doing this, a cylinder block temperature may be more uniform via inclusion of the first block curved passage 602, the second block curved passage 604, and the bridging curved passage 606 in the bore bridging area.

Figure 6C:
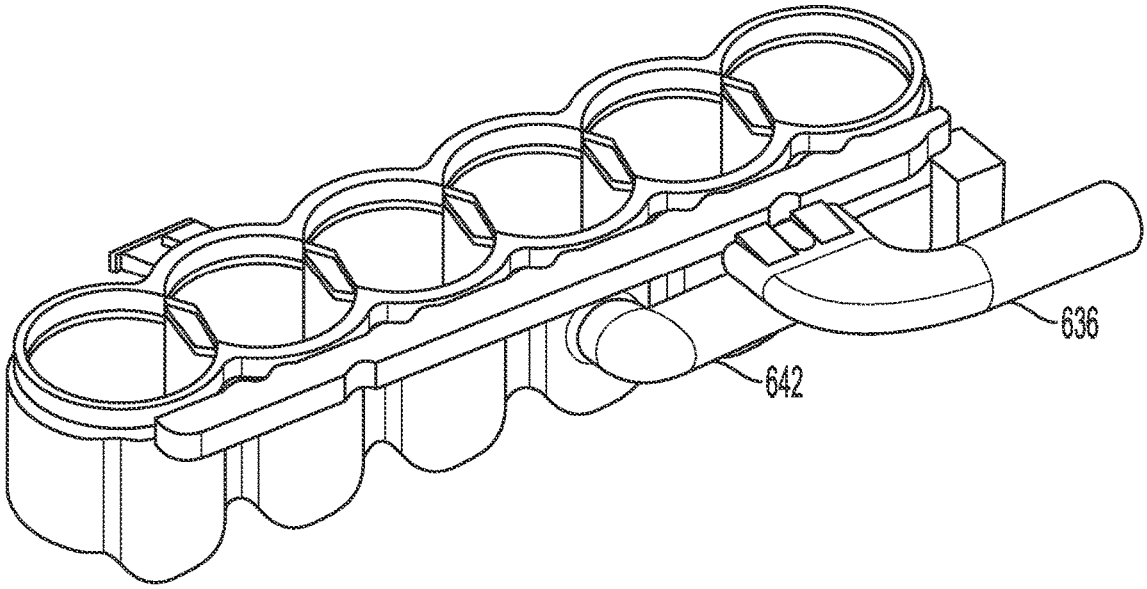
Figure 6D:
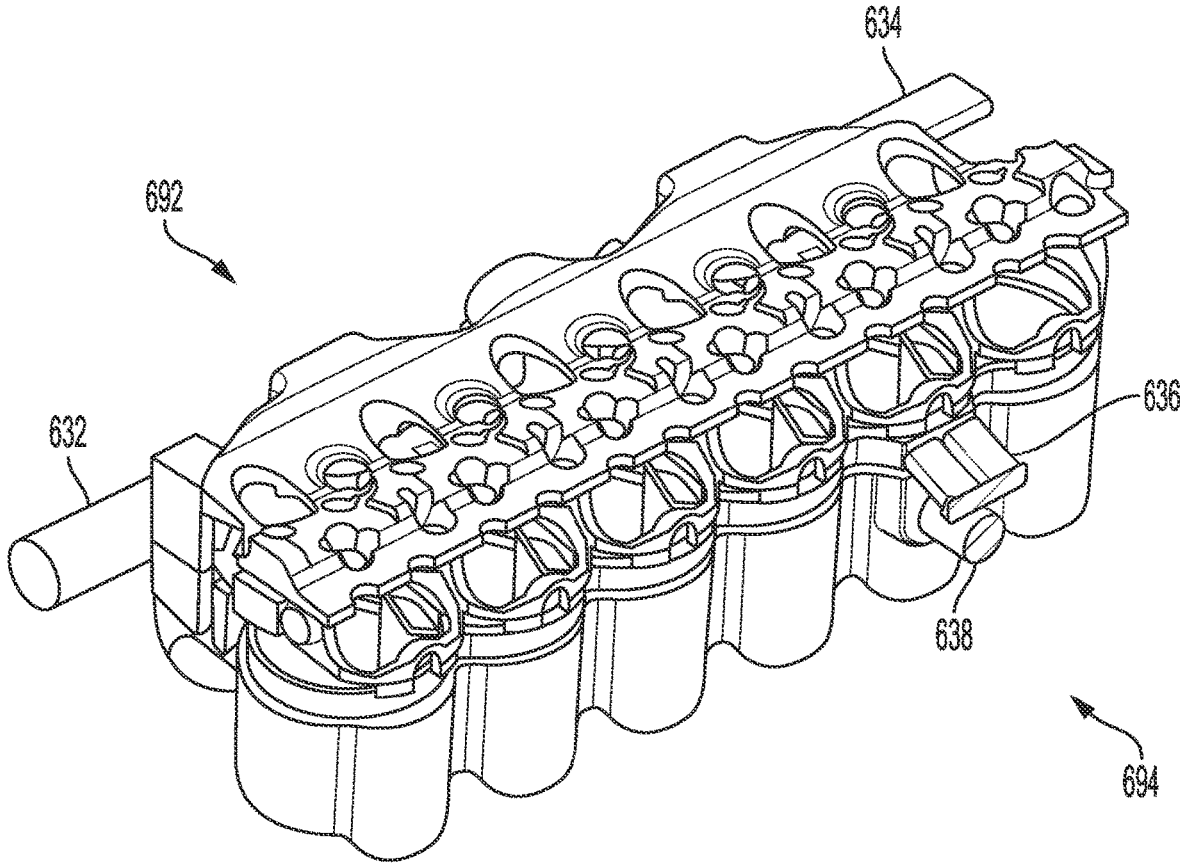

FIG. 6D shows a plurality of coolant passages fluidly coupled to the coolant passages of the bore bridging area. A coolant inlet 632 may be arranged at a first side 692 of the engine. An upper block coolant outlet 636 may be arranged at a second side 694 of the engine, opposite the first side 692. As mentioned above, the first side 692 may be an exhaust side of the engine and the second side 694 may be an intake side of the engine. In this way, the coolant inlet 632 may flow a lowest temperature coolant to a hotter region (e.g., exhaust region) of the engine.

An upper head coolant outlet 634 may be arranged proximally to the first side 692 of the engine. In one example, the upper head coolant outlet 634 is arranged at an end of the engine opposite to an end at which the coolant inlet 632 is arranged. In the example of FIG. 6D, the engine is a six-cylinder, inline engine. The coolant inlet 632 is arranged adjacent to cylinder 1 of the engine and the upper head coolant outlet 634 is arranged adjacent to cylinder 6 of the engine. It will be appreciated that alternate arrangements may be used.

A lower block coolant outlet 638 may also be arranged on the second side 694, adjacent to the upper block coolant outlet 636. In one example, the lower block coolant outlet 638 may expel coolant from only the lower block jacket portion 252 of FIG. 2 and the upper block coolant outlet 636 may expel coolant from only the upper block jacket portion 248 of FIG. 2. In the examples where the block coolant jacket is divided into three or more portions, as shown in FIG. 3D, the number of block coolant outlets may be increased to match the number of block coolant jacket portions.

A block outlet bypass 642 is shown in FIG. 6C. The block outlet bypass 642 may expel coolant from the lower block jacket portion and flow the coolant directly to the pump, as will be described in greater detail below with respect to FIG. 7.

Turning now to FIG. 7, it shows a detailed view of a cooling arrangement 700. The cooling arrangement 700 may be used in any of the examples of FIGS. 2, 4, and 5. The cooling arrangement 700 may include a pump 710 configured to flow coolant to a distribution chamber 712. The distribution chamber 712 may be integrally arranged into an engine block. In one example, the distribution chamber 712 is integrally arranged in an upper block portion 714 of the engine block as a single piece.

The distribution chamber 712 may direct coolant to the upper block portion 714 and/or to a lower, exhaust side, head portion 722. In one example, the distribution chamber 712 may include a valve or other control device configured to adjust a flow rate of coolant to each of the upper block portion 714 and the lower, exhaust side, head portion 722. The lower, exhaust side, head portion 722 may be fluidly coupled to each of an upper, exhaust side, head portion 724, and an intake side head portion 726. In one example, coolant from the intake side head portion 726 may flow to the upper, exhaust side, head portion 724 such that all coolant leaving the head flows through the upper, exhaust side, head portion 724 prior to flowing through one or more outlets.

One or more outlets may be fluidly coupled to the upper, exhaust side, head portion 724. A first outlet 725 may direct gases and/or coolant from the upper, exhaust side, head portion 724 to a degas bottle 701. A second outlet 727 may direct coolant from the upper, exhaust side, head portion 724 to one or more of a turbocharger 729, an EGR cooler 730, an engine oil cooler 731, and a transmission oil cooler 732. Coolant flow to the turbocharger 729, the EGR cooler 730, the engine oil cooler 731, and the transmission oil cooler 732 may be based on respective temperature thresholds. For example, coolant flow to the turbocharger 729 may be requested in response to a temperature of the turbocharger 729 being outside a desired turbocharger temperature range. For example, if the temperature of the turbocharger 729 is above the desired turbocharger temperature range, then coolant may flow from the upper, exhaust side, head portion 724, through the second outlet 727, to the turbocharger 729. Additionally or alternatively, if the temperature of the turbocharger 729 is below the desired turbocharger temperature range and less than a coolant temperature, then coolant may flow from the upper, exhaust side, head portion 724, through the second outlet 727, to the turbocharger 729 to heat the turbocharger.

Coolant flow to the EGR cooler 730 may be demanded in response to one or more of an engine temperature, an engine total $NO_x$ output, and an EGR cooler temperature. For example, if the engine total $NO_x$ output is above a desired threshold, then cooler EGR gases may be desired to further decrease $NO_x$ output.

Each of the turbocharger 729, the EGR cooler 730, the engine oil cooler 731, and the transmission oil cooler 732 may flow coolant to a coolant control module 750, which will be described in greater detail below. A third outlet 728 may flow coolant from the upper, exhaust side, head portion 724 to a lower block portion 716 of the engine block. The upper block portion 714 is fluidly separated from the lower block portion 716 via a separator 718, which may be identical to separator 254 of FIG. 2. As such, a single block coolant jacket may include each of the upper and lower block portions, wherein coolant mixing between the upper and lower block portions is blocked via the separator 718. A lower block bypass 732 may branch from the third outlet 728. A lower block bypass valve 733 may be configured to control a coolant flow rate through the lower block bypass 732. The lower block bypass valve 733 may be mechanically controlled or electrically controlled. The lower block bypass valve 733 may be adjusted to a fully closed position (e.g., 0% flow), a fully open position (e.g., 100% flow), or to a position therebetween.

A fourth outlet 734 may flow coolant from the upper block portion 714 to the control module 750. In one example, the fourth outlet 734 may include an upper block outlet valve 735 configured to adjust a coolant flow rate through the fourth outlet. The upper block outlet valve 735 may be mechanically controlled or electrically controlled. The upper block outlet valve 735 may be adjusted to a fully closed position (e.g., 0% flow), a fully open position (e.g., 100% flow), or to a position therebetween.

A fifth outlet 736 may flow coolant from the lower block portion 716 to the control module 750. In one example, the fifth outlet 736 is free of a valve such that coolant flow through the fifth outlet 736 is uninterrupted. A block degas passage 737 may branch from each of the fourth outlet 734 and the fifth outlet 736. The block degas passage 737 may allow gases and/or coolant to flow to the degas bottle 726 from the fourth outlet 734 and/or the fifth outlet 736.

The control module 750 may include a plurality of inlets and a plurality of outlets. One or more of the plurality of inlets may be variably controlled, open/closed, or uncontrolled (e.g. constantly open). One or more of the plurality of outlets may be variably controlled, open/closed, or uncontrolled (e.g. constantly open).

The control module 750 may include a first volume 752, which may include a first inlet 754 and a first outlet 756. The first inlet 754 may receive coolant from the degas bottle 726 via a degas outlet passage 753. The coolant may enter the first volume 752, wherein the coolant is contained within the first volume 752 and does not mix with coolant in a second volume 760 of the control module 750 via a partition 758. Coolant from the first volume 752 may be expelled via the first outlet 756. In one example, the first inlet 754 may be adjusted to either an open position or a closed position. To simplify operation and cost, the first inlet 754 may not be variably adjustable, such that the first inlet 754 may be adjusted to only the open position or the closed position. The first outlet 756 may be open during all conditions, which may further decrease an operating complexity and manufacturing cost of the control module 750.

The control module 750 may further include a second inlet 762, a third inlet 763, a fourth inlet 764, a fifth inlet 765, and a sixth inlet 766 fluidly coupled to only the second volume 760. Coolant in the second volume 760 may not mix with and is sealed from coolant in the first volume 752.

The second inlet 762 may be open during all conditions. The second inlet 762 may be configured to receive coolant from the fourth outlet 734. In some examples, the upper block outlet valve 735 may be omitted and the second inlet 762 may be variably controlled without departing from the scope of the present disclosure.

The third inlet 763 may be adjusted to an open position or a closed position. The third inlet 763 may not be variably controlled such that a position of the third inlet 763 is adjusted to only the open position or the closed position. The third inlet 763 may receive coolant from one or more of the turbocharger 729, the EGR cooler 730, and the transmission oil cooler 732 via a first coolant return passage 767.

The fourth inlet 764 may be variably adjusted to an open position, a closed position, or any position therebetween. The fourth inlet 764 may be fluidly coupled to the fifth outlet 735. Thus, the position of the fourth inlet 764 may control a coolant flow rate out of the lower block portion 716.

The fifth inlet 765 may be adjusted to an open position or a closed position. The fifth inlet 765 may not be variably controlled such that a position of the fifth inlet 765 is adjusted to only the open position or the closed position. The fifth inlet 765 may receive coolant from the engine oil cooler 731 via a second coolant return passage 768. In some examples, additionally or alternatively, the third inlet 763 and the fifth inlet 765 may be combined into a single inlet. In doing so, the first coolant return passage 767 and the second coolant return passage 768 may merge into a single passage upstream of the combined third and fifth inlet.

The sixth inlet 766 may be adjusted to an open position or a closed position. The sixth inlet 766 may not be variably controlled such that a position of the sixth inlet 766 is adjusted to only the open position or the closed position. The sixth inlet 766 may be fluidly coupled to the lower block bypass 732. In some examples, the position of the sixth inlet 766 may be fixed to only the open position. In other examples, the lower block bypass valve 733 may be omitted and the position of the sixth inlet 766 may be variably adjusted (e.g., adjusted to the open position, the closed position, or any position therebetween.

Coolant in the second volume 760 may be expelled via the plurality of outlets including a second outlet 772, a third outlet 774, and a fourth outlet 776. Each of the second outlet 772, the third outlet 774, and the fourth outlet 776 may include where positions thereof are adjustable. In one example, the position of the second outlet 772 may be adjusted to either an open position or a closed position. The position of the third outlet 774 may be adjusted to an open position, a closed position, or any position therebetween. The position of the fourth outlet 776 may be adjusted to an open position, a closed position, or any position therebetween.

The second outlet 772 may flow coolant directly to a pump feed line 780. The pump feed line 780 may flow coolant from the control module 750 to the pump 710. The first outlet 756 may flow coolant from the first volume 752 directly to the pump feed line 780. In this way, a temperature of coolant flowing from the second outlet 772 or the first outlet 756 may not be modified after exiting respective volumes of the coolant control module 750 and flowing to the pump 710.

The third outlet 774 may flow coolant directly to a radiator 782. The radiator 782 may include a serpentine-shaped passage. The radiator 782 may further include vanes configured to allow air or another gas to pass over the serpentine-shaped passage, which may decrease a temperature of coolant in the radiator 782. A radiator outlet 784 may direct coolant from the radiator to the pump feed line 780.

The fourth outlet 776 may flow coolant directly to a heater 786. The heater 786 may include a serpentine-shaped passage. In one example, the heater 786 is identical to the exhaust gas heat exchanger 540 of FIG. 5. Additionally or alternatively, the heater 786 may include an electric heater or other heating device powered by consumption of an energy source. The heater 786 may increase a temperature of coolant flowing thereto. A heater outlet 788 may flow coolant from the heater 786 to the pump feed line 780.

Turning now to FIG. 8, it shows a method for operating the coolant control module and valves of a cooling arrangement, such as the cooling arrangements of FIGS. 2, 4, 5, and 7. Instructions for carrying out method 800 may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

The method 800 begins at 802, which includes determining if an engine is on. The engine may be on if one or more of the engine is receiving fuel, if an ignition key is turned, if an ignition button is depressed, and the like. If the engine is not on, then at 804, the method 800 may include not flowing coolant. In one example, the coolant control module may be deactivated and coolant flow to various portions of the engine may be blocked.

In some examples, the vehicle may be in an all-electric mode, start/stop, or coasting event where the engine is not fueled but the vehicle is on. In such an example, the coolant control module may block coolant flow to the engine and focus coolant flow to electrical portions of the powertrain, such as the electric motor and/or the battery. Additionally or alternatively, during the start/stop and the coasting event, it may be desired to maintain engine operating temperatures such that a restart of the engine does not result in a cold-start due to inactivity. As such, coolant may flow to the engine or its components if a temperature of the coolant is greater than a temperature of the engine or its components and a likelihood of cold-start upon the engine restart is increasing.

If the engine is on and being fueled, then at 806, the method 800 may include determining if a cold-start is occurring. A cold-start may be occurring if an engine temperature is less a lower temperature of a desired engine operating range. Additionally or alternatively, a cold-start may be occurring if an engine temperature is less than an ambient temperature.

If a cold-start is occurring, then at 808, the method 800 may include blocking coolant flow to a degas bottle. In one example, blocking coolant flow to the degas bottle may include adjusting a position of the first inlet of the coolant control module to a closed position. Additionally or alternatively, coolant lines leading from the head and the block may be sealed such that coolant may not flow therefrom to the degas bottle.

At 810, the method 800 may further include blocking coolant flow to each of the turbocharger, the EGR cooler, the engine oil cooler, and the transmission oil cooler. In one example, a temperature of the turbocharger, the engine oil cooler, and the transmission oil cooler may be less than a desired operating temperature due to the cold-start. As such, coolant may not be requested during the cold-start. Coolant may not flow to the EGR cooler due to an EGR demand being relatively low (e.g., zero) during the cold-start.

At 812, the method 800 may include flowing coolant to only the heater, head coolant jacket, and block coolant jacket. As such, the third outlet of the coolant control module may be opened and the first and second outlets may be sealed. The second and fourth inlets of the coolant control module may be opened and the first, third, fifth, and sixth inlets may be sealed. As described above, flowing coolant to the head and block coolant jackets may include flowing coolant to an exhaust side of the head coolant jacket and an upper portion of the block coolant jacket. Coolant may flow through a remainder of the head coolant jacket and rapidly warm up due to higher cylinder temperatures near the head. Coolant exiting the head coolant jacket may flow to a lower portion of the block coolant jacket, fluidly sealed from the upper portion, and heat up the lower portion of the cylinder.

In some examples, coolant flow through the head coolant jacket and the upper portion of the block coolant jacket may be stagnated to further accelerate warming of the coolant. By heating the coolant more rapidly, hot coolant may be delivered to other areas of the engine that are slower to warm-up, such as the lower portion of the block coolant jacket.

At 814, the method 800 may include determining if the cold-start is still occurring. If the cold-start is still occurring, then at 816, the method 800 may include maintaining current operating parameters. In this way, coolant flow to the degas bottle, turbocharger, EGR cooler, engine oil cooler, and turbocharger oil cooler is blocked. Coolant may flow to only the heater, the head coolant jacket, and the block coolant jacket.

If the cold-start is complete or if the engine start is not a cold-start at 806, then at 818, the method 800 may include allowing coolant to flow to the degas bottle. In one example, the first inlet of the coolant control module may be adjusted to an open position and coolant lines leading from the head and the block may be opened such that coolant may flow therefrom to the degas bottle.

At 820, the method 800 may include adjusting a coolant flow rate to one or more of the head, block, turbocharger, EGR cooler, engine oil cooler, and transmission oil cooler. The coolant flow rate may be adjusted based on one or more of a knock likelihood at 822, friction at 824, a turbocharger temperature at 826, an EGR temperature at 828, an engine oil temperature at 830, and a transmission oil temperature at 832. The knock likelihood may be based on one or more of an in-cylinder pressure, pressure, an ignitability of the combustion mixture. If the knock likelihood is above a desired knock likelihood value, then the coolant flow rate may be adjusted to flow coolant directly from the pump to the upper portion of the block coolant jacket. Additionally or alternatively, coolant may be directed to the radiator, via adjusting a position of the second outlet to a more open or fully open position, to decrease an overall temperature of the engine.

Friction may be estimated based on a sensed piston speed compared to a predicted piston speed, wherein friction is proportional to the difference between the sensed and predicted piston speeds. Additionally or alternatively, friction may be estimated based on a temperature of the lower portion of the block coolant jacket. In one example, it may be desired to maintain the lower portion of the block coolant jacket, and therefore a lower portion of the cylinder, at a threshold lower portion temperature. The threshold lower portion temperature may be equal to a non-zero, positive number, empirically determined to reduce friction while also meeting desired engine operating temperatures.

Coolant flow may further be adjusted to meet one or more desired operating temperature of the turbocharger, the EGR cooler, the engine oil cooler, and the transmission oil cooler. For example, if the turbocharger temperature is above a desired turbocharger temperature range, then the coolant flow rate thereto may be increased to decrease the turbocharger temperature. Additionally or alternatively, if the turbocharger temperature is less than the desired turbocharger temperature range and a coolant temperature, then the coolant flow rate thereto may be increased to increase the turbocharger temperature to at least substantially match the coolant temperature.

If EGR cooling is desired, which may be based on an engine temperature, engine $NO_x$ output, or other engine condition, then the coolant flow rate to the EGR cooler may be increased. As another example, if the engine oil temperature is above a desired engine oil temperature range, then the coolant flow rate to the engine oil cooler may be increased to decrease the engine oil temperature. Additionally or alternatively, if the engine oil temperature is less than the desired engine oil temperature range and the coolant temperature, then the coolant flow rate thereto may be increased to increase the engine oil temperature at least substantially match the coolant temperature. As another example, if the transmission oil temperature is above a desired transmission oil temperature range, then the coolant flow rate to the transmission oil cooler may be increased to decrease the transmission oil temperature. Additionally or alternatively, if the transmission oil temperature is less than the desired transmission oil temperature range and the coolant temperature, then the coolant flow rate thereto may be increased to increase the transmission oil temperature at least substantially match the coolant temperature.

In this way, a cylinder temperature may be fine-tuned to reduce engine knock while also decreasing friction and bore distortions. A separator may be used to seal two or more portions of a block coolant jacket. The technical effect of sealing different volumes of the block coolant jacket from one another is to maintain different desired temperatures based on engine operating conditions. Maintaining a lower temperature in the upper portion of the block coolant jacket may decrease a knock likelihood while maintaining a higher temperature in the lower portion may increase fuel economy and decrease bore distortions.

The disclosure provides support for a system including a separator arranged in a block coolant jacket, wherein the separator seals an upper portion of the block coolant jacket from a lower portion of the block coolant jacket. A first example of the system further includes where the separator is uniform along an entire circumference of the block coolant jacket. A second example of the system, optionally including the first example, further includes where the separator is non-uniform. A third example of the system, optionally including one or more of the previous examples, further includes where the separator comprises two or more of a V-shaped section, a linear section, and a chamfered section. A fourth example of the system, optionally including one or more of the previous examples, further includes where liquid transfer between the upper portion and the lower portion is blocked by the separator, and where the separator comprises a plurality of orifices configured to allow coolant in the lower portion to degas and flow gases to the upper portion. A fifth example of the system, optionally including one or more of the previous examples, further includes where the upper portion receives coolant directly from a coolant pump, and wherein the lower portion receives coolant from a head coolant jacket. A sixth example of the system, optionally including one or more of the previous examples, further includes where the separator is flexible. A seventh example of the system, optionally including one or more of the previous examples, further includes where the separator is biased toward a cylinder head, and wherein the upper portion is smaller than the lower portion.

The disclosure further provides support for a system including an engine comprising a plurality of cylinders, each cylinder of the plurality of cylinders comprising a head coolant jacket and a block coolant jacket, a separator arranged in the block coolant jacket, wherein the separator separates an upper portion of the block coolant jacket from a lower portion of the block coolant jacket, and a coolant circuit comprising a coolant control module and a pump, wherein the coolant circuit further comprises a distribution chamber configured to flow coolant to the head coolant jacket and the upper portion of the block coolant jacket. A first example of the system further includes where the coolant control module comprises a plurality of inlets and a plurality of outlets, wherein a number of the plurality of inlets is greater than a number of the plurality of outlets. A second example of the system, optionally including the first example, further includes where the head coolant jacket is fluidly coupled to the lower portion of the block coolant jacket. A third example of the system, optionally including one or more of the previous examples, further includes a plurality of bridge coolant areas, wherein each of the plurality of bridge coolant areas is arranged between adjacent cylinders of the plurality of cylinders. A fourth example of the system, optionally including one or more of the previous examples, further includes where the coolant circuit is fluidly coupled to the plurality of bridge coolant areas, and wherein coolant flow to the plurality of bridge coolant areas is independent of coolant flow to the head coolant jacket and the block coolant jacket. A fifth example of the system, optionally including one or more of the previous examples, further includes where each the plurality of bridge coolant areas comprises three half-circle shaped sections, wherein two half-circle shaped sections are arranged in a block area of each of the plurality of bridge coolant areas and another half-circle shaped section is arranged in a head area of each of the plurality of bridge coolant areas. A sixth example of the system, optionally including one or more of the previous examples, further includes where the separator is further configured to separate the upper portion and the lower portion from one another and from a middle portion of the block coolant jacket, wherein the middle portion is arranged between the upper portion and the lower portion.

The disclosure further provides support for a cooling arrangement for an engine including a head coolant jacket arranged in a cylinder head, wherein the head coolant jacket is in thermal communication with an exhaust port, an exhaust valve, an intake port, and an intake valve, a block coolant jacket arranged in a cylinder block, wherein the block coolant jacket comprises a separator dividing the block coolant jacket into at least an upper volume and a lower volume, wherein coolant in the upper volume does not mix with coolant in the lower volume, and a coolant control module configured to receive coolant from one or more of the head coolant jacket, the block coolant jacket, and a degas bottle. A first example of the cooling arrangement further includes where the coolant control module comprises a first volume and a second volume, and wherein coolant from the degas bottle flows to only the first volume of the coolant control module, and wherein coolant from the head coolant jacket and the block coolant jacket flow to only the second volume when flowing to the coolant control module. A second example of the cooling arrangement, optionally including the first example, further includes where the coolant control module further comprises inlets fluidly coupled to the second volume configured to receive coolant from a turbocharger, an exhaust gas recirculate cooler, an engine oil cooler, and a transmission oil cooler. A third example of the cooling arrangement, optionally including one or more of the previous examples, further includes where the coolant control module further comprises a plurality of outlets configured to flow coolant from the second volume to one or more of a radiator, a heater, and a pump, and wherein coolant leaving the radiator and the heater flows to the pump. A fourth example of the cooling arrangement, optionally including one or more of the previous examples, further includes where coolant in the first volume does not mix with coolant in the second volume.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a separator arranged in a block coolant jacket of an engine cylinder block, wherein the separator seals an upper portion of the block coolant jacket from a lower portion of the block coolant jacket, wherein liquid transfer between the upper portion and the lower portion is blocked by the separator, and where the separator comprises a plurality of orifices configured to allow coolant in the lower portion to degas and flow gases to the upper portion.

2. The system of claim 1, wherein the separator is uniform along an entire circumference of the block coolant jacket.

3. The system of claim 1, wherein the separator is non-uniform.

4. The system of claim 3, wherein the separator comprises two or more of a V-shaped section, a linear section, and a chamfered section.

5. The system of claim 1, wherein the upper portion receives coolant directly from a coolant pump, and wherein the lower portion receives coolant from a head coolant jacket.

6. The system of claim 1, wherein the separator is flexible.

7. The system of claim 1, wherein the separator is biased toward a cylinder head, and wherein the upper portion is smaller than the lower portion.

8. A system, comprising:

an engine comprising a plurality of cylinders, each cylinder of the plurality of cylinders comprising a head coolant jacket and a block coolant jacket;

a separator arranged in the block coolant jacket, wherein the separator blocks liquid transfer between an upper portion of the block coolant jacket and a lower portion of the block coolant jacket, the separator further comprising a plurality of orifices configured to allow coolant in the lower portion to degas and flow gases to the upper portion; and a coolant circuit comprising a coolant control module and a pump, wherein the coolant circuit further comprises a distribution chamber configured to flow coolant to the head coolant jacket and the upper portion of the block coolant jacket, and wherein the coolant control module comprises a plurality of inlets and a plurality of outlets.

9. The system of claim 8, wherein a number of the plurality of inlets is greater than a number of the plurality of outlets.

10. The system of claim 8, wherein the head coolant jacket is fluidly coupled to the lower portion of the block coolant jacket.

11. The system of claim 8, further comprising a plurality of bridge coolant areas, wherein each of the plurality of bridge coolant areas is arranged between adjacent cylinders of the plurality of cylinders.

12. The system of claim 11, wherein the coolant circuit is fluidly coupled to the plurality of bridge coolant areas, and wherein coolant flow to the plurality of bridge coolant areas is independent of coolant flow to the head coolant jacket and the block coolant jacket.

13. The system of claim 11, wherein each the plurality of bridge coolant areas comprises three half-circle shaped sections, wherein two half-circle shaped sections are arranged in a block area of each of the plurality of bridge coolant areas and another half-circle shaped section is arranged in a head area of each of the plurality of bridge coolant areas.

14. The system of claim 8, wherein the separator is further configured to separate the upper portion and the lower portion from one another and from a middle portion of the block coolant jacket, wherein the middle portion is arranged between the upper portion and the lower portion.

15. A cooling arrangement for an engine, comprising:

a head coolant jacket arranged in a cylinder head of the engine, wherein the head coolant jacket is in thermal communication with an exhaust port, an exhaust valve, an intake port, and an intake valve;

a block coolant jacket arranged in a cylinder block of the engine, wherein the block coolant jacket comprises a separator dividing the block coolant jacket into at least an upper volume and a lower volume, wherein the separator blocks coolant in the upper volume from mixing with coolant in the lower volume, the separator further comprising a plurality of orifices configured to allow coolant in the lower portion to degas and flow gases to the upper portion; and a coolant control module configured to receive coolant from one or more of the head coolant jacket, the block coolant jacket, and a degas bottle, wherein the coolant control module comprises a plurality of inlets and a plurality of outlets.

16. The cooling arrangement of claim 15, wherein the coolant control module comprises a first volume and a second volume, and wherein coolant from the degas bottle flows to only the first volume of the coolant control module, and wherein coolant from the head coolant jacket and the block coolant jacket flow to only the second volume when flowing to the coolant control module.

17. The cooling arrangement of claim 16, wherein the coolant control module further comprises inlets fluidly coupled to the second volume configured to receive coolant from a turbocharger, an exhaust gas recirculate cooler, an engine oil cooler, and a transmission oil cooler.

18. The cooling arrangement of claim 16, wherein the coolant control module further comprises a plurality of outlets configured to flow coolant from the second volume to one or more of a radiator, a heater, and a pump, and wherein coolant leaving the radiator and the heater flows to the pump.

19. The cooling arrangement of claim 16, wherein coolant in the first volume does not mix with coolant in the second volume.

* * * * *